US006013603A

United States Patent [19]

Asajima et al.

[11] Patent Number: 6,013,603

[45] Date of Patent: Jan. 11, 2000

[54] IMAGE-RECEIVING SHEET

[75] Inventors: Mikio Asajima; Seiji Take, both of Shinjuku-ku, Japan

[73] Assignee: Dai Nippon Printing Co., Ltd.

[21] Appl. No.: 09/115,908

[22] Filed: Jul. 15, 1998

[30] Foreign Application Priority Data

Jul. 18, 1997 [JP] Japan ..... 9-208315

[51] Int. Cl.[7] ..... B41M 5/035; B41M 5/38

[52] U.S. Cl. ..... 503/227; 428/195; 428/500; 428/522; 428/913; 428/914

[58] Field of Search ..... 8/471; 428/195, 428/500, 522, 913, 914; 503/227

[56] References Cited

U.S. PATENT DOCUMENTS 5,156,709 10/1992 Mammino et al. ..... 156/235

FOREIGN PATENT DOCUMENTS 0 633 508 A2 1/1995 European Pat. Off. ..... 503/227
1 696 253 11/1971 Germany ..... 503/227

OTHER PUBLICATIONS

Patent Abstracts of Japan; vol. 096, No. 010; Oct. 31, 1996 & JP 08 160652 A (DAI Nippon Printing Co, Ltd); Jun. 21, 1996 *abstract*.

*Primary Examiner*—Bruce H. Hess
*Attorney, Agent, or Firm*—Parkhurst & Wendel, L.L.P.

[57] ABSTRACT

An image-receiving sheet having an opaque detection mark formed by coating a resin varnish comprising a resin, a low-boiling good solvent, and a high-boiling poor solvent, the detection mark being rendered transparent upon heating, the resin comprising a terpolymer of vinyl chloride, vinyl acetate, and vinyl alcohol monomers. By virtue of this constitution, before image formation, the detection mark has high opacity and can be detected in high sensitivity, that is, does not cause a lowering in infrared radiation transmission or reflectance properties before heating at the time of image information, while when an image is formed by means of a copying machine or a printer in high-processing electrophotographic system, thermal transfer system or the like, heating and application of pressure at the time of image formation erases the detection mark to such an extent that the detection mark is no longer visually noticeable.

5 Claims, No Drawings

IMAGE-RECEIVING SHEET

BACKGROUND OF THE INVENTION

This invention relates to an image-receiving sheet, and more particularly to an image-receiving sheet, for use in electrophotographic system, thermal transfer system or the like where the image-receiving sheet is heated at the time of image formation, that enables an opaque detection mark to be rendered transparent upon exposure to heat and pressure at the time of image formation.

In recent years, formation of a monochromatic image of black as well as formation of a full-color image by mixing of three-color toners of yellow, magenta, and cyan, or four-color toners of the above three colors, yellow, magenta, and cyan, and black using an electrophotographic system has been put to practical use.

In order to steadily record and hold record information, such as letters and images, an image-receiving sheet used in the electrophotographic copying machine comprises a substrate having thereon a receptive layer. This image-receiving sheet is used, for example, for OHP (overhead projector) as information transmission means which is used in lecture meetings, schools, enterprises, other briefing sessions, exhibitions and the like.

In the electrophotographic system, detection means is provided in order to detect paper jamming or to discriminate one side of paper from the other side, or, in the case of color image formation, to register image patterns of three colors of yellow, magenta, and cyan, or four colors of the above three colors, yellow, magenta, and cyan, and black on an identical image-receiving sheet. In particular, in image formation on a transparent image-receiving sheet, for example, optical detection means is provided wherein light from a light source is applied to a transparent image-receiving sheet and the presence or absence of reflected light or the presence or absence of transmitted light is detected by a photosensor.

For example, a detection mark has been formed using an opaque ink or an ink having metallic luster. Further, the applicant of the present invention has proposed, in Japanese Patent Laid-Open Nos. 49581/1995 and 56376/1995, an image-receiving sheet having an opaque detection mark that can be rendered transparent upon heating at the time of image formation and, when the formed image is projected by an overhead projector, permits only a necessary image to be projected without creation of a visually noticeable shadow in the projection of the detection mark.

The detection mark described in Japanese Patent Laid-Open Publication Nos. 49581/1995 and 56376/1995 is formed by coating a transparent resin varnish comprising a resin, a low-boiling good solvent, and a high-boiling poor solvent and then drying the coating to cause gelation, thereby forming an opaque porous layer. This detection mark, when heated at the time of image formation, permits the resin to be melted and rendered transparent, thus erasing the detection mark.

In the above conventional image-receiving sheets, the capability of the detection mark to be rendered transparent upon heating at the time of image formation and the coating strength and the like of the detection mark layer vary depending upon the resin constituting the detection mark, that is, the type of the resin and the difference in degree of polymerization or molecular weight even in the same type of resin.

Further, in copying machines and printers for image formation in an electrophotographic system, a thermal transfer system or the like, the image-receiving sheet has become carried at a high speed in order to improve the processing efficiency. This has led to lowered energy in heating and pressing at the time of image formation.

Under the above circumstance, application of satisfactory heat and pressure to the detection mark in copying machines and printers in a high-speed electrophotographic system or thermal transfer system has become impossible, posing a problem that the conventional image-receiving sheet is unsatisfactory in the erasability of the detection mark upon heating at the time of image formation.

In order to solve this problem, an attempt has been made to reduce the coating thickness of the detection mark (not more than 1.7 $g/m^2$ on dry weight basis) to improve the erasability of the detection mark. The reduction in the coating thickness of the detection mark leads to a problem that the initial properties such as light transmittance and reflectance properties of the detection mark (i.e., properties before thermal printing at the time of image formation) are lowered where by the detection mark becomes hard to be detected.

Accordingly, an object of the present invention is to solve the above problems of the prior art and to provide an image-receiving sheet having an opaque detection mark that, when an image is formed by copying machines or printers in high-speed electrophotographic system, thermal transfer system or the like, can be rendered transparent upon exposure to heat and pressure at the time of image formation to such an extent that the detection mark is no longer visually noticeable, and, before image formation, does not undergo a lowering in infrared transmittance and reflectance properties before heating at the time of image formation.

DISCLOSURE OF INVENTION

In order to attain the above object, the prevent invention provides an image-receiving sheet having an opaque detection mark formed by coating a resin varnish comprising a resin, a low-boiling good solvent, and a high-boiling poor solvent, the detection mark being rendered transparent upon heating, the resin comprising a terpolymer of vinyl chloride, vinyl acetate, and vinyl alcohol monomers.

The degree of polymerization of the terpolymer is preferably not more than 500.

Preferably, in the terpolymer, the total molar fraction of vinyl chloride and vinyl acetate is not less than 50% with the molar fraction of vinyl alcohol being 1 to 10%.

Further, preferably, the resin further comprises a copolymer (B) containing not less than 50% of vinyl chloride monomer, the above-mentioned terpolymer (A) and the copolymer (B) are in the form of a mixture in a terpolymer (A) to copolymer (B) ratio of 1:5 to 1:1.

The degree of polymerization of the copolymer (B) is preferably not more than 300.

According to the present invention, in the image-receiving sheet having an opaque detection mark, which has been formed by coating a resin varnish comprising a resin, a low-boiling good solvent, and a high-boiling poor solvent and can be rendered transparent upon heating, use of a resin, comprising a terpolymer of vinyl chloride, vinyl acetate, and vinyl alcohol monomers, as the resin constituting the detection mark is advantageous in that, before image formation, the detection mark has good infrared transmittance and reflectance properties, that is, has high opacity and can be detected in high sensitivity, while at the time of image formation by copying machines or printers in high-speed electrophotographic system or thermal transfer system or the like, the detection mark can be erased, upon exposure to heat and pressure at the time of image information, to such an extent that the detection mark is no longer visually noticeable.

BEST MODE FOR CARRYING OUT THE INVETNION

Preferred embodiments of the present invention will be described.

The image-receiving sheet of the present invention has an opaque detection mark formed by coating a resin varnish comprising a resin, a low-boiling good solvent, and a high-boiling poor solvent. The detection mark is rendered transparent upon heating, and the resin comprises a terpolymer of vinyl chloride, vinyl acetate, and vinyl alcohol monomers.

Substrate

Preferably, the substrate in the image-receiving sheet according to the present invention, when used in applications where a recorded image is viewed by utilizing transmitted light, for example, OHP sheets, is made of a thermoplastic resin, having transparency, heat resistance, dimensional stability, and rigidity. Specific examples of substrates usable herein include films or sheets, having a thickness of about 10 to 250 $\mu$m, preferably 50 to 180 $\mu$m, of polyethylene terephthalate resin, polyethylene naphthalate resin, polyester resin, polyacrylate resin, polycarbonate resin, acrylic resin, polyvinyl chloride resin, polypropylene resin, polystyrene resin, polyethylene resin, cellulose diacetate resin, cellulose triacetate resin and the like. Among them, films or sheets of polyethylene terephthalate resin, polyvinyl chloride resin, polypropylene resin, and cellulose triacetate resin are preferred from the viewpoint of the above properties. On the other hand, when the image-receiving sheet is used in applications where a recorded image is viewed by utilizing reflected light, the resin sheet or film is preferably opaque, for example, white. In order to render the resin sheet or film opaque, a colorant or the like may be added to the resin. Further, in this case, papers, such as synthetic papers and coated papers, may be used as the substrate. When the substrate is translucent, the image-receiving sheet may be used in illumination applications. In this connection, it should be noted that in order to improve the adhesion of the substrate to the layer provided on the substrate, the surface of the substrate may be subjected to conventional treatment for improving adhesion, such as primer treatment or corona discharge treatment. or corona discharge treatment.

Receptive layer

The receptive layer is provided on one side of the substrate either directly or through a primer layer. When the substrate per se is receptive to the ink, there is no need to provide the receptive layer. For example, in the case of thermal dye transfer recording, when the substrate per se, like a substrate made of a polyvinyl chloride resin, has dyeability and releasability from the thermal transfer sheet, there is no need to provide the receptive layer, because the substrate can serve also as the receptive layer.

The construction of the receptive layer may vary depending upon recording systems, for example, an electrophotographic system and thermal transfer systems, such as thermal ink transfer recording and thermal dye transfer recording. In the case of the electrophotographic system, resins usable for formation of the receptive layer include polyolefin resins, such as polyethylene and polypropylene, polyvinyl chloride, polyvinylidene chloride, polyvinyl acetate, vinyl chloride/vinyl acetate copolymer, polyacrylic esters, polyethylene terephthalate, polybutylene terephthalate, polystyrene resins, polyamide resins, copolymers of olefins, such as ethylene and propylene, with other vinyl monomers, ionomers, cellulosic resins, such as ethyl cellulose, cellulose acetate, and polycarbonate resins. Among them, vinyl resins, polyester resins, and vinyl chloride/vinyl acetate copolymer resin are particularly preferred.

The receptive layer may be formed by adding various optional assistants to the above resin component, dissolving or dispersing the mixture in a suitable solvent to prepare a coating composition, coating the composition on a substrate sheet by a conventional method, for example, gravure printing, screen printing, reverse roll coating using a gravure plate, and drying the resultant coating.

The thickness of the receptive layer is generally in the range of from 0.1 to 10 $\mu$m on a dry basis.

Regarding optional assistants which may be added to the receptive layer in the electrophotographic system include, for example, fine particles of fluoropolymers, such as an ethylene tetrafluoride polymer and an ethylene/ethylene tetrafluoride copolymer, salts of stearic acid, such as zinc stearate, organic polymers, such as polyethylene and polystyrene, fine particles of inorganic materials, such as silica and alumina, wax, silicone oil, surfactants, vegetable oils, animal oils, mineral oils and the like may be used for the purpose of imparting lubricity to the receptive layer. Among them, fluoropolymers are best suited for imparting the lubricity because they as such have excellent surface lubricity.

Further, in order to prevent a plurality of image-receiving sheets from being traveled together in an overlapped state due to blocking which is likely to cause at the time of feeding of the image-receiving sheet to the printer, fine particles of organic polymers, for example, polyolefins, such as polyethylene, polystyrene, polyacrylonitrile and an ethylene/acrylic acid copolymer, fine particles of inorganic fillers, for example, silica, kaolin, clay, talc, silica rock, aluminum hydroxide, titanium dioxide, calcium carbonate, aluminum sulfate, and zinc oxide, and fine particles of glass beads may be incorporated in the receptive layer. In the case of OHP applications, the fine particles are added in such an amount as will not be detrimental to the transparency of the receptive layer.

In the thermal ink transfer recording and the thermal dye transfer recording, upon heating, the receptive layer serves to receive a colorant transferred from the thermal transfer sheet. In particular, preferably, when the colorant is a sublimable dye, the receptive layer receives the colorant, permits the colorant to develop a color, and prevents resublimation of the once received dye. The receptive layer is composed mainly of a resin. A large number of resins may be used for constituting the receptive layer, and examples thereof include resins having an ester bond, resins having an urethane bond, resins having an amide bond, resins having a urea bond, other resins having a highly polar bond, mixtures of the above resins, and copolymers of monomers constituting the above resins. Among them, a mixture of an ethylene/vinyl acetate copolymer with polyvinyl chloride is preferred.

In the receptive layer, if necessary, organic or inorganic fillers or the like may be added to the above resin. Further, in the case of thermal dye transfer recording, a release agent may be added in order to improve the releasability of the receptive layer, upon heating, from the thermal transfer sheet.

Examples of release agents usable herein include silicone oils, phosphoric ester surfactants, and fluorosurfactants. Among them, silicone oils are preferred. Preferred silicone oils include modified silicone oils, such as epoxy-modified, alkyl-modified, amino-modified, carboxyl-modified, alcohol-modified, fluorine-modified, alkylaralkylpolyether-modified, epoxy-polyether-modified, and polyether-modified silicone oils. These release agents may be used alone or as a mixture of two or more. The amount of the release agent added is preferably 0.5 to 20 parts by weight based on 100 parts by weight of the binder resin for constituting the receptive layer. When the amount is outside the above range, in some cases, problems occur such as heat fusing, between the thermal transfer sheet and the receptive layer, and lowered printing sensitivity.

In order to impart an antistatic property, the following antistatic agents may be incorporated into a coating liquid for the receptive layer. The incorporation of the antistatic agent may be conducted also in a coating liquid for the receptive layer in the electrophotographic system.

Antistatic agents: fatty acid esters, sulfuric esters, phosphoric esters, amides, quaternary ammonium salts, betaines, amino acids, acrylic resins, ethylene oxide adducts and the like.

The amount of the antistatic agent added is preferably 0.1 to 2.0% by weight based on the resin.

Methods for forming the receptive layer for thermal ink transfer recording and thermal dye transfer recording include methods described above in connection with the formation of the receptive layer for electrophotographic copying.

The thickness of the receptive layer for thermal ink transfer recording and thermal dye transfer recording is generally 0.1 to 10 $\mu$m on a dry basis.

Primer layer

A primer layer may be optionally provided between the receptive layer and the substrate from the viewpoint of stabilizing the adhesion between the substrate and the receptive layer. The primer layer may be formed of a conventional material selected from linear polyesters, isocyanates and the like.

Charge control layer

In order to prevent the image-receiving sheet from being contaminated due to deposition of dust and to prevent a plurality of image-receiving sheets from being traveled together in an overlapped state, an antistatic layer containing the following surfactant may be provided on the surface of the receptive layer and/or on the outermost surface of the image-receiving sheet on the backside of the substrate. Alternatively, the antistatic layer may be provided directly on the front side and/or the backside of the substrate. The antistatic layer contains an antistatic agent, and examples of antistatic agents usable herein include, for example, cationic antistatic agents, such as quaternary ammonium salts and polyamine derivatives, anionic antistatic agents, such as alkyl phosphates, and nonionic antistatic agents, such as fatty acid esters. If necessary, a lubricant may be incorporated in the antistatic layer so that the sheet can be slid smoothly upon heat fixation and carried stably.

Backside layer

A backside layer may be provided on the backside of the substrate remote from the receptive layer in order to impart suitable slip properties for stably carrying the image-receiving sheet in a printer and to prevent curling of the image-receiving sheet.

The backside layer comprises, for example, a binder resin, organic or inorganic fine particles, and an antistatic agent. The binder resin may be the same as that described above in connection with the receptive layer, and the antistatic agent may be the same as that described above in connection with the antistatic layer. Examples of organic or inorganic fine particles usable herein include those that do not sacrifice the transparency of the image-receiving sheet, for example, materials having refractive index close to the binder in the backside layer, for example, silica, talc, alumina, calcium carbonate and other inorganic fine particles, and organic fillers, such as fine particles of teflon, fine particles of crosslinked urea resin, fine particles of styrene/acrylic resin, melamine resin, and polycarbonate resin.

Intermediate layer

In the present invention, an intermediate layer comprising various resins may be provided between the substrate sheet and the receptive layer. Excellent functions can be added to the image-receiving sheet by allowing the intermediate layer to play various roles.

A resin having large elastic deformation or plastic deformation, for example, a polyolefin resin, a vinyl copolymer resin, a polyurethane resin, or a polyamide resin, may be used as the resin for imparting a cushioning property to improve the sensitivity of the image-receiving sheet or to prevent formation of a harsh image. Provision of an intermediate layer formed of a resin having a glass transition temperature of 60° C. or above or a resin cured with a curing agent or the like can improve the storage stability of the image-receiving sheet, for example, can prevent adhesion of a plurality of image-receiving sheets to each other when the plurality of the sheets are stored in a laminated state.

The intermediate layer may be formed by adding the above resin, additives and the like, thoroughly kneading the mixture with a solvent, a diluent or the like to prepare a coating liquid, coating the coating liquid on a substrate sheet by the same method as described above in connection with the formation of the receptive layer, for example, gravure printing, screen printing, or reverse roll coating using a gravure plate, and drying the coating.

Detection mark

In the image-receiving sheet of the present invention, a detection mark is provided. The detection mark is opaque and formed by coating a resin varnish comprising a resin, a low-boiling good solvent, and a high-boiling poor solvent. The detection mark is rendered transparent upon heating, and the resin comprises a terpolymer of vinyl chloride, vinyl acetate, and vinyl alcohol monomers.

Before use in an electrophotographic copying machine (a printer) or a thermal transfer printer, the detection mark is in the form of a porous opaque layer. On the other hand, upon exposure to heat and heat/pressure in fixation at the time of image formation in the printer, the detection mark is rendered transparent.

Upon drying after coating of a transparent resin varnish comprising a resin, a low-boiling good solvent, and a high-boiling poor solvent on the image-receiving sheet, the good solvent having a relatively low boiling point is preferentially evaporated. The evaporation of the good solvent causes phase separation between the resin phase and the remaining poor solvent phase in the resin varnish. This causes the resin to gel, while the poor solvent is dispersed as particles in the resin. As drying further proceeds, evaporation of the particulate high-boiling poor solvent proceeds. Upon the completion of the evaporation of the poor solvent, an opaque porous resin layer is formed. In the opaque porous resin layer thus formed, the resin is melted and rendered transparent by heat during recording or by heat treatment after recording.

According to the detection mark constituted by the opaque porous resin layer, a terpolymer of vinyl chloride, vinyl acetate, and vinyl alcohol monomers is used as the resin constituting the mark. In this case, the resin may further contain a copolymer of four or more monomers, that is, the above three monomers and a further monomer, such as (meth)acrylate.

The degree of polymerization of the terpolymer of the vinyl chloride, vinyl acetate, and vinyl alcohol monomers is preferably not more than 500. In the present invention, the term "degree of polymerization" used herein refers to the average degree of polymerization.

Use of a terpolymer having a degree of polymerization exceeding 500, due to its high melting point, makes it difficult to erase the detection mark upon exposure to heat and pressure at the time of image information in copying machines or printers in high-speed electrophotographic system, thermal transfer system or the like.

When the copolymer has a higher degree of polymerization, the detection mark layer is no longer porous.

On the other hand, when the degree of polymerization is less than 100, the strength of the coating as the detection mark layer is excessively low, which is unfavorable for practical use.

Preferably, the terpolymer having a degree of polymerization of not more than 500 has a melting point of 30 to 150° C., particularly 50 to 100° C. When the melting point exceeds 150° C., problems unfavorably occurs such as thermal deformation of the substrate when the porous resin layer is melted at the time of image formation (fixation of toner). On the other hand, a melting point below 30° C. is unfavorable from the viewpoint of storage stability of the image-receiving sheet and the like, because blocking is likely to occur at a high temperature.

The terpolymer, of vinyl chloride, vinyl acetate, and vinyl alcohol monomers, constituting the detection mark is preferably such that the total molar fraction of vinyl chloride and vinyl acetate monomers is not less than 50% with the molar fraction of vinyl alcohol being 1 to 10%.

The above proportions of the monomers enable the detection mark to be erased to such an extent that the detection mark is no longer visually noticeable even when the detection mark cannot be exposed to satisfactory energy of heat and pressure in a copying machine or a printer in high-speed electrophotographic system, thermal transfer system or the like. Further, in this case, the opacity of the detection mark before the image formation is so high that the detection mark can be detected in high sensitivity.

When the molar fraction of the vinyl alcohol monomer exceeds 10%, it is unfavorably difficult to form a detection mark layer having a porous structure.

On the other hand, when the molar fraction of the vinyl alcohol monomer is less than 1%, unfavorably, it becomes difficult to fully erase the detection mark upon exposure to heat and pressure at the time of image formation in a copying machine or a printer in high-speed electrophotographic system, thermal transfer system or the like.

The detection mark according to the present invention can be fully erased even when it cannot be exposed to satisfactory energy of heat and pressure in a copying machine or a printer in high-speed electrophotographic system, thermal transfer system or the like. In addition, even when the coating thickness of the detection mark is relatively small (not more than 1.7 g/m$^2$ on dry weight basis), the opacity of the detection mark before image formation can be kept high. Furthermore, after image formation, the detection mark formed on the image-receiving sheet has no significant surface irregularities, that is, has high smoothness, and the image of the detection mark projected by an overhead projector is not substantially visually noticeable.

The resin constituting the detection mark may be formed of a mixture of the terpolymer of vinyl chloride, vinyl acetate, and vinyl alcohol monomers with a polymer compatible with the low-boiling good solvent, such as a copolymer of two or more monomers selected from vinyl chloride, vinyl acetate, and (meth)acrylate monomers, or an acrylic, polyester, polyamide resin or other resin, from the viewpoint of maintaining the strength of the coating as the detection mark layer.

In particular, use of a mixture of the terpolymer with a copolymer of vinyl chloride and vinyl acetate monomers is preferred. In this case, preferably, the terpolymer (A) of vinyl chloride, vinyl acetate, and vinyl alcohol monomers and the copolymer (B) containing vinyl chloride, preferably not less than 50% of vinyl chloride monomer are in the form of a mixture in a terpolymer (A) to copolymer (B) ratio of 1:5 to 1:1 from the viewpoint of imparting better erasability (capability of being rendered transparent upon heating or fixation) to the detection mark. The copolymer (B) can be a mixture of vinyl chloride and vinyl acetate monomers.

According to the present invention, when the resin constituting the detection mark has a relatively low melting point of about 50 to 100° C., in the formation of an image in a copying machine or a printer in high-speed electrophotographic system, thermal transfer system or the like, the detection mark can be erased even when the heating temperature at the time of image formation is relatively low.

For the resin constituting the detection mark, the term "poor solvent" refers to a solvent which has no or low solubility in the resin. Specific examples of poor solvents usable herein include hydrocarbon solvents, such as aliphatic hydrocarbons, aromatic hydrocarbons, and terpene hydrocarbons, halogenated hydrocarbons and alcohols. For the above resin, the term "good solvent" refers to a solvent having high solubility in the resin, and specific examples of good solvents include: for solvent-soluble resins, ketones, such as acetone, methyl ethyl ketone, and cyclohexane, esters, such as ethyl acetate, butyl acetate, and ethylene glycol acetate monomethyl ether; and, for some resins, aromatic hydrocarbons and alcohols. When a water-soluble resin is used, solvents are suitably selected by taking into consideration the compatibility with the resin in such a manner that the poor solvent for the solvent-soluble resin is a good solvent, while the good solvent for the solvent-soluble resin is a poor solvent. In general, the poor solvent is used in amount of 50 to 300 parts by weight based on 100 parts by weight of the resin. For the above good solvent and poor solvent, as can be understood from the above detection mark production process, the boiling point of the poor solvent should be relatively higher than that of the good solvent. Further, use of a combination of a good solvent and a poor solvent, which are soluble in each other, is preferred from the viewpoint of stable dispersion in the resin varnish.

In this connection, it should be noted that, in the present invention, regarding the low-boiling good solvent and high-boiling poor solvent, the term "high-boiling" or "low-boiling" means that the boiling point is relatively high or low in relationship between the good solvent and the poor solvent.

In the detection mark, a particulate lubricant may be incorporated into the resin varnish. Use of the lubricant accelerates the evaporation of the solvent at the time of drying of the resin varnish, resulting in improved productivity of the detection mark. An additional advantage associated with the use of the lubricant is that the coating strength of the detection mark as the printed layer can be improved, leading to improved scratch resistance. The lubricant is preferably a particulate organic lubricant having a diameter of 0.5 to 20 μm. Lubricants usable herein include particles of aliphatic hydrocarbons, such as petroleum wax, synthetic paraffins, polyethylene wax and montan wax, higher fatty acids and metal salts thereof, such as palmitic acid and stearic acid and aluminum, tin and zinc salts thereof, aliphatic alcohols, aliphatic esters, such as n-butyl stearate, n-hexyl stearate and octyl stearate, amides, such as stearic acid amide, palmitic acid amide and ethylenebispalmitic acid amide, and wax, such as carnauba wax. The amount of the lubricant used is generally 0.5 to 30 parts by weight, preferably 1 to 5 parts by weight, based on 100 parts by weight of the resin.

Preferably, the porous resin layer as the detection mark has an average pore diameter of 0.1 to 10 μm. When the average pore diameter is less than 0.1 μm, good opacity (whitened state) cannot be provided, leading to unsatisfactory function of the detection mark. On the other hand, when the average pore diameter is larger than 10 μm, the coating strength is low. The pore diameter of the porous resin layer may be regulated in the above range by optimizing the drying temperature, flow rate of air for drying, drying time, and particularly the mixing ratio of the poor solvent to the good solvent. For example, the size of particles can be ensured by bringing the difference in boiling point between the low-boiling good solvent and the high-boiling poor solvent to about 20 to 50° C.

For example, in the case of an electrophotographic copying machine, the resin component in the detection mark is melted by heat (100 to 150° C.) of a hot roll for fixation of a toner to the image-receiving sheet at the time of image formation and, upon resolidification, is rendered transparent.

The transmittance in a wavelength region of 400 to 1000 nm of the detection mark as the porous resin layer according to the present invention is not more than 50% before printing and not less than 75% after printing. In terms of the reflectance, the detection mark is not less than 20% before printing and not more than 10% after printing.

The detection mark of the present invention can be provided on a limited portion of the image-receiving sheet or in a pattern form on the image-receiving sheet. Specifically, the detection mark may be provided on a limited area, of the image-receiving sheet, such as one end or periphery of the image-receiving sheet. If the detection mark, which, when used in an overhead projector, is slightly visually perceived, is an eyesore, preferably, the detection mark is provided in an area other than the image-forming area. Further, the detection mark according to the present invention may be provided in a pattern form. Specific examples of the form of patterns includes stripes, circles, ellipses, triangles, and bar codes having a specified size.

Further, the detection mark according to the present invention may be provided by printing on one side or both sides of the image-receiving sheet, that is, on the receptive layer side or backside layer side of the substrate, on the substrate per se, or the outermost surface of the image-receiving sheet. That is, the detection mark may be printed on one side or both sides of the image-receiving sheet by conventional printing means, such as gravure printing, screen printing, or letterpress printing, and drying the print. For the detection mark, a coverage of 1 to 5 μm on a dry basis suffices for satisfactory properties.

The following examples further illustrate the present invention. In the following description, all "parts" or "%" are by weight unless otherwise specified.

EXAMPLE 1 coated on one side of a 75 μm-thick polyethylene terephthalate film as a substrate by reverse roll coating using a gravure plate to a thickness of 3 μm on a dry basis. A coating liquid 1, for a detection mark, having the following composition was gravure-printed on the receptive layer in its position corresponding to the corner of an image-receiving sheet to provide a detection mark having a thickness of 2 μm on a dry basis, thereby preparing an image-receiving sheet of Example 1.

| Composition for receptive layer | |
|---|---|
| Vinyl chloride/vinyl acetate copolymer (Denkalac #1000A, manufactured by Denki Kagaku Kogyo K.K.) | 6 parts |
| Polyester resin (Vylon 600, manufactured by Toyobo Co., Ltd.) | 4 parts |
| Methyl ethyl ketone:toluene = 1:1 | 90 parts |

| Coating liquid 1 for detection mark | |
|---|---|
| Vinyl chloride/vinyl acetate/vinyl alcohol terpolymer (#1000GSK, manufactured by Denki Kagaku Kogyo K.K., degree of polymerization 340, total molar fraction of vinyl chloride and vinyl acetate 94%, molar fraction of vinyl alcohol 6%) | 10 parts |
| Vinyl chloride containing copolymer solution (solid content: 57%) (Denkalac TF100, manufactured by Denki Kagaku Kogyo K.K., degree of polymerization 110, molar fraction of vinyl chloride 70–80%) | 30 parts |
| n-Butanol | 20 parts |
| n-Propanol | 20 parts |
| Acetone | 20 parts |

EXAMPLE 2

An image-receiving sheet of Example 2 was prepared in the same manner as in Example 1, except that a coating liquid 2, for a detection mark, having the following composition was used instead of the coating liquid 1 for a detection mark in Example 1.

| Coating liquid 2 for detection mark | |
|---|---|
| Vinyl chloride/vinyl acetate/vinyl alcohol terpolymer (#1000GKT, manufactured by Denki Kagaku Kogyo K.K., degree of polymerization 420, total molar fraction of vinyl chloride and vinyl acetate 94%, molar fraction of vinyl alcohol 6%) | 10 parts |
| Vinyl chloride containing copolymer solution (solid content: 50%) (Denkalac TF200, manufactured by Denki Kagaku Kogyo K.K., degree of polymerization 150, molar fraction of vinyl chloride 70–80%) | 30 parts |
| n-Butanol | 20 parts |
| n-Propanol | 20 parts |
| Acetone | 20 parts |

EXAMPLE 3

An image-receiving sheet of Example 3 was prepared in the same manner as in Example 1, except that a coating liquid 3, for a detection mark, having the following composition was used instead of the coating liquid 1 for a detection mark in Example 1.

| Coating liquid 3 for detection mark | |
|---|---|
| Vinyl chloride/vinyl acetate/vinyl alcohol terpolymer (degree of polymerization 380, total molar fraction of vinyl chloride and vinyl acetate 98%, molar fraction of vinyl alcohol | 10 parts |

-continued

| Coating liquid 3 for detection mark | |
|---|---|
| 2%) | |
| Vinyl chloride containing copolymer solution (solid content: 65%) (Denkalac TF120, manufactured by Denki Kagaku Kogyo K.K., degree of polymerization 120, molar fraction of vinyl chloride 70–80%) | 30 parts |
| n-Butanol | 20 parts |
| n-Propanol | 20 parts |
| Acetone | 20 parts |

EXAMPLE 4

An image-receiving sheet of Example 4 was prepared in the same manner as in Example 1, except that a coating liquid 4, for a detection mark, having the following composition was used instead of the coating liquid 1 for a detection mark in Example 1.

| Coating liquid 4 for detection mark | |
|---|---|
| Vinyl chloride/vinyl acetate/vinyl alcohol terpolymer (degree of polymerization 380, total molar fraction of vinyl chloride and vinyl acetate 96%, molar fraction of vinyl alcohol 4%) | 10 parts |
| Vinyl chloride containing copolymer solution (solid content: 65%) (Denkalac TF120, manufactured by Denki Kagaku Kogyo K.K., degree of polymerization 120, molar fraction of vinyl chloride 70–80%) | 30 parts |
| n-Butanol | 20 parts |
| n-Propanol | 20 parts |
| Acetone | 20 parts |

REFERENCE EXAMPLE 1

An image-receiving sheet of Reference Example 1 was prepared in the same manner as in Example 1, except that a coating liquid 5, for a detection mark, having the following composition was used instead of the coating liquid 1 for a detection mark in Example 1.

| Coating liquid 5 for detection mark | |
|---|---|
| Vinyl chloride/vinyl acetate/vinyl alcohol terpolymer (Denkalac LOH, manufactured by Denki Kagaku Kogyo K.K., degree of polymerization 410, total molar fraction of vinyl chloride and vinyl acetate 90%, molar fraction of vinyl alcohol 10%) | 40 parts |
| Vinyl chloride containing copolymer solution (solid content: 65%) (Denkalac TF120, manufactured by Denki Kagaku Kogyo K.K., degree of polymerization 120, molar fraction of vinyl chloride 70–80%) | 30 parts |
| n-Butanol | 20 parts |
| n-Propanol | 20 parts |
| Acetone | 20 parts |

REFERENCE EXAMPLE 2

An image-receiving sheet of Reference Example 2 was prepared in the same manner as in Example 1, except that a coating liquid 6, for a detection mark, having the following composition was used instead of the coating liquid 1 for a detection mark in Example 1.

| Coating liquid 6 for detection mark | |
|---|---|
| Vinyl chloride/vinyl acetate/vinyl alcohol terpolymer (Denkalac #1000GSK, manufactured by Denki Kagaku Kogyo K.K., degree of polymerization 340, total molar fraction of vinyl chloride and vinyl acetate 94%, molar fraction of vinyl alcohol 6%) | 40 parts |
| n-Butanol | 20 parts |
| n-Propanol | 20 parts |
| Acetone | 40 parts |

REFERENCE EXAMPLE 3

An image-receiving sheet of Reference Example 3 was prepared in the same manner as in Example 1, except that a coating liquid 7, for a detection mark, having the following composition was used instead of the coating liquid 1 for a detection mark in Example 1.

| Coating liquid 7 for detection mark | |
|---|---|
| Vinyl chloride/vinyl acetate/vinyl alcohol terpolymer (degree of polymerization 300, total molar fraction of vinyl chloride and vinyl acetate 70%, molar fraction of vinyl alcohol 3.0%) | 40 parts |
| n-Butanol | 20 parts |
| n-Propanol | 20 parts |
| Acetone | 40 parts |

REFERENCE EXAMPLE 4

An image-receiving sheet of Reference Example 4 was prepared in the same manner as in Example 1, except that a coating liquid 8, for a detection mark, having the following composition was used instead of the coating liquid 1 for a detection mark in Example 1.

| Coating liquid 8 for detection mark | |
|---|---|
| Vinyl chloride/vinyl acetate/vinyl alcohol terpolymer (degree of polymerization 700, total molar fraction of vinyl chloride and vinyl acetate 95%, molar fraction of vinyl alcohol 5%) | 40 parts |
| n-Butanol | 20 parts |
| n-Propanol | 20 parts |
| Acetone | 40 parts |

REFERENCE EXAMPLE 5

An image-receiving sheet of Reference Example 5 was prepared in the same manner as in Example 1, except that a coating liquid 9, for a detection mark, having the following composition was used instead of the coating liquid 1 for a detection mark in Example 1.

| Coating liquid 9 for detection mark | |
|---|---|
| Vinyl chloride/vinyl acetate/vinyl alcohol terpolymer (#1000GSK, manufactured by Denki Kagaku Kogyo K.K., degree of polymerization 340, total molar fraction of vinyl chloride and vinyl acetate 94%, molar fraction of vinyl alcohol 6%) | 20 parts |
| Vinyl chloride/vinyl acetate copolymer (#1000A, manufactured by Denki Kagaku Kogyo K.K., degree of polymerization 340, molar fraction of vinyl chloride 86%, molar fraction of vinyl acetate 14%) | 20 parts |

-continued

| Coating liquid 9 for detection mark | |
|---|---|
| n-Butanol | 20 parts |
| n-Propanol | 20 parts |
| Acetone | 40 parts |

REFERENCE EXAMPLE 6

An image-receiving sheet of Reference Example 6 was prepared in the same manner as in Example 1, except that a coating liquid 9, for a detection mark, having the following composition was used instead of the coating liquid 1 for a detection mark in Example 1.

| Coating liquid 10 for detection mark | |
|---|---|
| Vinyl chloride/vinyl acetate/vinyl alcohol terpolymer (#1000GKT, manufactured by Denki Kagaku Kogyo K.K., degree of polymerization 420, total molar fraction of vinyl chloride and vinyl acetate 94%, molar fraction of vinyl alcohol 6%) | 10 parts |
| Vinyl chloride containing copolymer solution (solid content: 57%) (Denkalac TF100, manufactured by Denki Kagaku Kogyo K.K., degree of polymerization 110, molar fraction of vinyl chloride 70–80%) | 10 parts |
| n-Butanol | 30 parts |
| n-Propanol | 30 parts |
| Acetone | 20 parts |

COMPARATIVE EXAMPLE 1

An image-receiving sheet of Comparative Example 1 was prepared in the same manner as in Example 1, except that a coating liquid 10, for a detection mark, having the following composition was used instead of the coating liquid 1 for a detection mark in Example 1.

| Coating liquid 11 for detection mark | |
|---|---|
| Vinyl chloride containing copolymer solution (solid content: 57%) (Denkalac TF100, manufactured by Denki Kagaku Kogyo K.K., degree of polymerization 110, molar fraction of vinyl chloride 70–80%) | 40 parts |
| n-Butanol | 20 parts |
| n-Propanol | 20 parts |
| Acetone | 20 parts |

COMPARATIVE EXAMPLE 2

An image-receiving sheet of Comparative Example 2 was prepared in the same manner as in Example 1, except that a coating liquid 11, for a detection mark, having the following composition was used instead of the coating liquid 1 for a detection mark in Example 1.

| Coating liquid 12 for detection mark | |
|---|---|
| Vinyl chloride containing copolymer solution (solid content: 57%) (Denkalac TF100, manufactured by Denki Kagaku Kogyo K.K., degree of polymerization 110, molar fraction of vinyl chloride 70–80%) | 30 parts |
| Acrylic resin (BR 85, manufactured by Mitsubishi Rayon Co., Ltd.) | 10 parts |
| n-Butanol | 20 parts |
| n-Propanol | 20 parts |

-continued

| Coating liquid 12 for detection mark | |
|---|---|
| Acetone | 20 parts |

A certain image was formed using the image-receiving sheets of the above examples and comparative examples by an electrophotographic copying machine (COLOR LASER COPIER 700, manufactured by Canon Inc.).

For evaluation before image formation, the transmittance and reflectance of the detection mark in the image-receiving sheet were measured by the following methods.

For evaluation after image formation, the haze of the detection mark in the image-receiving sheet was measured by the following method.

Transmittance

The transmittance of the detection mark in the image-receiving sheet before image formation was measured with a transmission densitometer UV-3100 manufactured by Shimadzu Seisakusho Ltd.

Reflectance

The reflectance of the detection mark in the image-receiving sheet before image formation was measured with a reflection densitometer UV-3100 manufactured by Shimadzu Seisakusho Ltd.

Haze

The haze of the detection mark in the image-receiving sheet after image formation was measured with a haze meter manufactured by Nippon Denshoku Co., Ltd. The image-receiving sheet after image formation was visually inspected using an overhead projector to evaluate the heat erasability of the detection mark. Criteria for the evaluation were as follows.

○: The detection mark could be fully erased to such an extent that the mark, even when enlarged with an overhead projector, was not visually noticeable.

x: The detection mark somewhat remained unerased, and, when enlarged with an overhead projector, was visually noticeable.

Evaluation results

The evaluation results for the examples and comparative examples are summarized in Table 1.

TABLE 1

| | Transmittance, % | Reflectance, % | Haze, % | Heat erasability |
|---|---|---|---|---|
| Ex. 1 | 8.0 | 75 | 8.0 | ○ |
| Ex. 2 | 8.0 | 75 | 8.0 | ○ |
| Ex. 3 | 8.0 | 75 | 10.0 | ○ |
| Ex. 4 | 8.0 | 75 | 8.0 | ○ |
| Reference Example 1 | 8.0 | 80 | 8.0 | ○ |
| Reference Example 2 | 16.0 | 70 | 9.0 | ○ |
| Reference Example 3 | 20.0 | 60 | 7.0 | ○ |
| Reference Example 4 | 9.0 | 80 | 15.0 | ○ |
| Reference Example 5 | 8.0 | 75 | 15.0 | ○ |
| Reference Example 6 | 20.0 | 60 | 7.0 | ○ |
| Comp. Ex. 1 | 60.0 | 30 | —*1 | —*1 |
| Comp. Ex. 2 | 7.0 | 75 | 25.0 | X |

TABLE 1-continued

| | Transmittance, % | Reflectance, % | Haze, % | Heat erasability |
|---|---|---|---|---|

*1: For the image-receiving sheet of Comparative Example 1, the detection mark could not be formed as a porous opaque layer and hence could not be detected by the electrophotographic copying machine, making it impossible to form an image.

The image-receiving sheet according to the present invention has an opaque detection mark formed by coating a resin varnish comprising a resin, a low-boiling good solvent, and a high-boiling poor solvent, the detection mark being rendered transparent upon heating, the resin comprising a terpolymer of vinyl chloride, vinyl acetate, and vinyl alcohol monomers. By virtue of this constitution, when an image is formed by means of a copying machine or a printer in high-processing electrophotographic system, thermal transfer system or the like, heating and application of pressure at the time of image formation can erase the detection mark to such an extent that the detection mark is longer visually noticeable.

Further, before image formation, the detection mark does not undergo a lowering in infrared radiation transmission or reflectance before heating at the time of image information. That is, before image information, the detection mark in the image-receiving sheet has high opacity and can be detected in high sensitivity.

We claim:

1. An image-receiving sheet having an opaque detection mark formed by coating a resin varnish comprising a resin, a low-boiling good solvent, and a high-boiling poor solvent, the detection mark being rendered transparent upon heating, the resin comprising a terpolymer of vinyl chloride, vinyl acetate, and vinyl alcohol monomers.

2. The image-receiving sheet according to claim 1, wherein the terpolymer has a degree of polymerization of not more than 500.

3. The image-receiving sheet according to claim 1, wherein, in the terpolymer, the total molar fraction of vinyl chloride and vinyl acetate is not less than 50% with the molar fraction of vinyl alcohol being 1 to 10%.

4. The image-receiving sheet according to claim 1, wherein the resin further comprises a copolymer (B) containing not less than 50% of vinyl chloride, the terpolymer (A) defined in claim 1 and the copolymer (B) being in the form of a mixture in a terpolymer (A) to copolymer (B) ratio of 1:5 to 1:1.

5. The image-receiving sheet according to claim 4, wherein the copolymer (B) has a degree of polymerization of not more than 300.

* * * * *